US008142579B2

(12) United States Patent
Koma

(10) Patent No.: US 8,142,579 B2
(45) Date of Patent: Mar. 27, 2012

(54) PROCESS FOR PRODUCING ALUMINUM ALLOY MATERIAL AND HEAT TREATED ALUMINUM ALLOY MATERIAL

(75) Inventor: Hisanori Koma, Aichi (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 139 days.

(21) Appl. No.: 12/526,061

(22) PCT Filed: Jan. 18, 2008

(86) PCT No.: PCT/JP2008/051022

§ 371 (c)(1), (2), (4) Date: Aug. 6, 2009

(87) PCT Pub. No.: WO2008/099651

PCT Pub. Date: Aug. 21, 2008

(65) Prior Publication Data

US 2010/0319820 A1 Dec. 23, 2010

(30) Foreign Application Priority Data

Feb. 13, 2007 (JP) ..... 2007-032017

(51) Int. Cl.
*C22F 1/04* (2006.01)

(52) U.S. Cl. ..... 148/697; 148/698

(58) Field of Classification Search ..... 148/697, 148/698, 695

See application file for complete search history.

(56) References Cited

FOREIGN PATENT DOCUMENTS

| | | |
|---|---|---|
| JP | 2-294454 | 12/1990 |
| JP | 3-44452 | 2/1991 |
| JP | 9-111426 | 4/1997 |
| JP | 2004-176134 | 6/2004 |
| JP | 2005-213529 | 8/2005 |

OTHER PUBLICATIONS

T. Minoda et al., "Grain Refinement of 7475 Based Aluminum Alloy Sheet by Warm Rolling," Journal of Japan Institute of Light Metals, vol. 51, No. 12, pp. 651-655 (2001).

*Primary Examiner* — Roy King
*Assistant Examiner* — Janelle Morillo
(74) *Attorney, Agent, or Firm* — Finnegan, Henderson, Farabow, Garrett & Dunner, LLP

(57) ABSTRACT

According to the present invention, a process for producing an aluminum alloy material, whereby reduction in toughness and in fatigue strength of the aluminum alloy material can be inhibited even after solution treatment is provided. Also, the following is provided: a process for producing an aluminum alloy material comprising at least the steps of subjecting a heat treatable aluminum alloy material to solution treatment and applying aging treatment to the aluminum alloy material subjected to solution treatment, which further comprises the following step between the solution treatment step and the aging treatment step: the step of subjecting the aluminum alloy material to plastic forming in a manner such that a given amount of equivalent strain is imparted to the aluminum alloy material from at least two directions while the aluminum alloy material subjected to solution treatment is maintained under temperature conditions that do not cause softening of the aluminum alloy material by over-aging.

4 Claims, 3 Drawing Sheets

(a)

(b)

PROCESS FOR PRODUCING ALUMINUM ALLOY MATERIAL AND HEAT TREATED ALUMINUM ALLOY MATERIAL

CROSS-REFERENCE TO RELATED APPLICATIONS

This application is a national phase application of International Application No. PCT/JP2008/051022, filed Jan. 18, 2008, and claims the priority of Japanese Application No. 2007-032017, filed Feb. 13, 2007, the contents of both of which are incorporated herein by reference.

TECHNICAL FIELD

The present invention relates to a process for producing an aluminum alloy material. In particular, the present invention relates to a process for producing a heat treated aluminum alloy material, which comprises a solution treatment and an aging treatment.

BACKGROUND ART

In recent years, aluminum alloy materials have been gaining attention as materials for vehicle structural members and the like from a global environmental viewpoint. For instance, when a product is manufactured using a heat treated aluminum alloy material comprising an Al—Cu—Mg base alloy, Al—Mg—Si base alloy, or Al—Zn—Mg base alloy, an aluminum alloy material is first formed into a desired shape by shape forming, which involves press shaping or the like. Next, solution treatment is applied to the aluminum alloy material subjected to shape forming in a manner such that a solid solution is formed with precipitation strengthening elements contained in the aluminum alloy material. Thereafter, precipitation is induced such that precipitates comprising, for example, $Mg_2Si$ are formed in the aluminum alloy material. Then, in order to harden the aluminum alloy material, an aging treatment is carried out at a temperature below the recrystallization temperature. However, in the above production process, an aluminum alloy material is heated above the recrystallization temperature during solution treatment. As a result, the strength of the aluminum alloy material decreases. Therefore, desired strength cannot be achieved in some cases, even if the alloy material is subjected to aging treatment.

In view of this problem of strength reduction, a process for producing an aluminum alloy material shown in, for example, FIG. 4 has been suggested. Specifically, a suggested process for producing an aluminum alloy material comprises at least the steps of: carrying out plastic forming (i.e., severe forming) by repeatedly imparting plastic strain to an aluminum alloy material (to which Zr or Sc that is able to form a thermally stable compound has been preliminarily added) under warm conditions prior to solution treatment; applying solution treatment to the aluminum alloy material subjected to plastic forming; and applying aging treatment to the aluminum alloy material subjected to solution treatment (see Non-Patent Document 1). According to the above production process, it is possible to inhibit recrystallization of an aluminum alloy material, which is caused during a solution treatment, by preliminarily adding Zr or Sc as an additive element to an aluminum alloy material. In addition, it is possible to miniaturize crystal grains in an aluminum alloy material by repeatedly imparting plastic strain to an aluminum alloy material under warm conditions. Thus, the material strength can be improved. Further, the plastic forming is carried out prior to solution treatment, which means plastic forming can be carried out during shape forming of an aluminum alloy material. Thus, plastic strain can be efficiently (in terms of time) imparted to an aluminum alloy material in a less.

Non-Patent Document 1: Tadashi Minoda et al., Crystal grain miniaturization of a 7475 aluminum alloy plate material by warm rolling, The Japan Institute of Light Metals, December, 2001, vol. 51, no. 12, pp. 651-655

DISCLOSURE OF THE INVENTION

The addition of Zr or Sc described in Non-Patent Document 1 is advantageous in that it allows the occurrence of recrystallization of an aluminum alloy material to be inhibited during solution treatment. However, in such case, it is necessary to raise the solution treatment temperature above the recrystallization temperature. Accordingly, crystal grains in an aluminum alloy material might be partially coarsened (average grain size of crystal grains: 50 μm or more) due to thermal effects of solution treatment. As a result, coarsened crystal grains can easily damage an aluminum alloy material, which might result in significant reduction in aluminum alloy material strength.

In particular, strain generated during plastic forming prior to a solution treatment generally results in non-uniform strain distribution in an aluminum alloy material. Therefore, even if crystal grain miniaturization is caused prior to a solution treatment, it is highly probable that crystal grains would become partially coarsened in a portion with a high strain amount after solution treatment. Accordingly, the toughness and the fatigue strength of an aluminum alloy material are reduced in some cases.

The present invention has been made in view of the above problems. Therefore, it is an object of the present invention to provide a process for producing an aluminum alloy material, whereby reduction in toughness and in fatigue strength of the aluminum alloy material can be inhibited even after solution treatment.

In order to achieve the above object, the process for producing an aluminum alloy material of the present invention is characterized in that it comprises at least the steps of subjecting a heat treatable aluminum alloy material to solution treatment and applying aging treatment to the aluminum alloy material subjected to solution treatment. The production process further comprises the following step between the solution treatment step and the aging treatment step: the step of subjecting the aluminum alloy material to plastic forming in a manner such that a given amount or equivalent strain is imparted to the aluminum alloy material from at least two directions while the aluminum alloy material subjected to solution treatment is maintained under temperature conditions that do not cause softening of the aluminum alloy material by over-aging.

According to the present invention, plastic forming is carried out in a manner such that a given amount of equivalent strain is imparted to an aluminum alloy material. Thus, crystal grains in an aluminum alloy material can be miniaturized to the several-micrometer amount. Further, the plastic forming step that corresponds to the miniaturization treatment is carried out following solution treatment and therefore miniaturized crystal grains do not become coarsened. Furthermore, in the plastic forming step, the above aluminum alloy material is further subjected to plastic forming under temperature conditions (including heating temperature and heating time conditions upon heating) that do not cause softening of the aluminum alloy material (subjected to solution treatment) by over-aging. Then, aging treatment is applied to the aluminum alloy material containing miniaturized crystal grains. Thus, fine precipitates can be obtained from a solid solution formed with solid solution elements (precipitation strengthening elements) contained in an aluminum matrix through aging precipitation. As a result, it becomes possible to secure a Vickers hardness of an aluminum alloy material of Hv 100 or more and to improve the toughness and fatigue strength of a standard product of aluminum alloy material only via heat treatment without the addition of additional alloy elements. Thus, an aluminum alloy material that is excellent in terms of recyclability can be obtained.

Herein, examples of a heat treatable aluminum alloy material used in the present invention include 2000 series, 4000 series, 6000 series, and 7000 series aluminum alloy materials specified in Japanese Industrial Standards (JIS) such as Al—Cu—Mg base aluminum alloy materials, Al—Si base aluminum alloy materials, Al—Mg—Si base aluminum alloy materials, and Al—Zn—Mg base aluminum alloy materials. However, examples are not limited to the above as long as they are aluminum alloy materials that can be hardened by heat treatment.

In addition, the term "solution treatment" used in the present invention refers to a heat treatment wherein the aforementioned heat treatable aluminum alloy material is heated at an adequate temperature (the solid solubility limit temperature or above) such that a sufficient solid solution is formed with alloy components, following which rapid cooling is carried out to obtain an oversaturated solid solution. Such treatment involves a quenching treatment (hardening treatment) for the obtained heated aluminum alloy material. The temperature of heating an aluminum alloy material during solution treatment is not less than the temperature at which a saturated solid solution formed with precipitation strengthening elements (solid solution elements) can be obtained by solving and diffusing the solid solution elements. In addition, such temperature is not more than the temperature at which burning of an aluminum alloy material starts. When the heating temperature is below the above temperature, an insufficient solid solution is formed with the elements and thus the strength of an aluminum alloy material cannot be improved by aging treatment. When the heating temperature exceeds the above temperature, eutectic elements having low melting points become melted, resulting in defect formation and leading to strength reduction.

Further, the term "aging treatment" used in the present invention refers to treatment comprising heating precipitation strengthening elements (solid solution elements) in an aluminum alloy material subjected to solution treatment in a manner such that precipitates are formed through precipitation induced by heating. During aging treatment, the temperature of heating an aluminum alloy material is between a temperature at which precipitates can be formed as a result of precipitation and a temperature at which softening of the aluminum alloy material is not caused by over-aging; that is to say, a temperature at which maximum levels of properties (e.g., hardness and strength) can be obtained as a result of aging.

In addition, the expression "temperature conditions that do not cause softening of the aluminum alloy material (subjected to solution treatment) by over-aging" used for the present invention refers to temperature conditions (including heating temperature and heating time conditions upon heating) that do not cause softening of an aluminum alloy material by over-aging, which causes aggregation of precipitates comprising precipitation strengthening elements. Also, under preferable temperature conditions, the state of a saturated solid solution comprising solid solution elements (precipitation strengthening elements) in an aluminum alloy material can be maintained, such elements having been formed into a solid solution and diffused during solution treatment. That is to say, under preferable temperature conditions, the state of a saturated solid solution comprising solid solution elements is unlikely to be changed, such elements having been formed into a solid solution and diffused during solution treatment. Under such conditions, precipitate formation as a result of precipitation is suppressed in an aluminum alloy material and thus plastic forming can be efficiently carried out before hardening of the aluminum alloy material takes place as a result of aging precipitation.

More preferably, in the process for producing an aluminum alloy material of the present invention, the temperature conditions for the aluminum alloy material range from 0° C. to 250° C. When the temperature conditions are below 0° C., maintenance of cold temperatures results in cost increase and poor deformability. When the temperature exceeds 250° C., the aluminum alloy material might be softened by over-aging upon plastic forming.

In addition, the expression "subjecting the aluminum alloy material to plastic forming in a manner such that a given amount of equivalent strain is imparted to the aluminum alloy material from at least two directions" used for the present invention refers to the following case. For instance, when an X axis, a Y axis, and a Z axis are superimposed on an aluminum alloy material, in order to miniaturize crystal grains in the aluminum alloy material, plastic forming is carried out in a manner such that a given amount of equivalent strain is imparted to the aluminum alloy material from at least two directions selected from among tension/compression directions along the axes and torsional directions of the axes serving as center axes. Such plastic forming corresponds to so-called severe forming or severe strain forming. In addition, the term "a given amount of equivalent strain" refers to the total amount of strain accumulated in each axis direction when plastic deformation is repeatedly induced. It is substantially equal to an equivalent plastic amount of strain because an elastic amount of strain is significantly lower than a plastic amount of strain.

More preferably, in the production process of the present invention, the above plastic forming is carried out in a manner such that the above given amount of equivalent strain becomes 2 or more. According to the present invention, a given amount of equivalent strain of 2 or more is achieved and thus aluminum alloy material crystal grains can be securely miniaturized to the order of several micrometers.

More preferably, in the process for producing an aluminum alloy material of the present invention, the above plastic forming is carried out to achieve an average crystal grain size (average grain size of crystal grains) of the aluminum alloy material of 5.0 μm or less. According to the present invention, an aluminum alloy material is subjected to plastic forming in a manner such that the above average grain size range is achieved.

Thus, a solid solution comprising solid solution elements in an aluminum matrix is formed into fine precipitates as a result of precipitation. Therefore, toughness and fatigue strength can be improved. In addition, it is preferable for an aluminum alloy material to have a small average grain size. However, in view of ease of production, the average grain size is 0.5 μm or more. In a case of an aluminum alloy material having a crystal grain size of more than 5.0 μm, it is difficult to improve both toughness and fatigue strength even if aging treatment is carried out following plastic forming.

More preferably, in the process for producing an aluminum alloy material of the present invention, the average crystal grain size is adjusted to 5.0 μm or less by the plastic forming, following which aging treatment is carried out to achieve a Vickers hardness of the aluminum alloy material of Hv 112 or more. According to the present invention, both toughness and fatigue strength can be further improved by adjusting the Vickers hardness of the aluminum alloy material within the above range.

More preferably, in the process for producing an aluminum alloy material of the present invention, after the aluminum alloy material is heated at the above temperature conditions during the step of carrying out the plastic forming, the aging treatment is carried out while the state of the heated aluminum alloy material in the step of carrying out the plastic forming is maintained. According to the present invention, an aluminum alloy material is continuously subjected to aging treatment following the step of carrying out plastic forming without cooling and thus it is not necessary to carry out reheating upon aging treatment. Therefore, an aging treatment can be carried out at lower cost.

Examples of plastic forming include: plastic forming induced by tension/compression; plastic forming induced by distortion; plastic forming induced by the ECAP method (Equal-Channel Angular Pressing method) wherein an aluminum alloy material is allowed to pass through a die groove having, for example, a uniform curved cross section in a manner such that shear deformation is imparted to an aluminum alloy material using the curved portion and thus crystal grains in the material can be miniaturized; and plastic forming carried out by combining the above examples of plastic forming. There is no particular limitation as long as a given amount of equivalent strain can be imparted. However, more preferably, the plastic forming is carried out by forging forming in the process for producing an aluminum alloy material of the present invention. According to the present invention, a given amount of equivalent strain can be imparted to an aluminum alloy material in a precise manner such that uniformly miniaturized crystal grains can be obtained.

Further, a heat treated aluminum alloy material is also disclosed for the present invention. The heat treated aluminum alloy material of the present invention has an average crystal grain size of 5.0 μm or less and a Vickers hardness of Hv 112 or more. According to the present invention, it is possible to obtain an aluminum alloy material haying excellent toughness and fatigue strength represented by a toughness of more than 350 MPa and a fatigue strength of approximately 150 MPa by achieving an average grain size and a Vickers hardness that fall within the respective ranges. In addition, when the average crystal grain size is more than 5.0 μm or the Vickers hardness is less than Hv 112, it is impossible to obtain an aluminum alloy material having a toughness of more than 350 MPa and a fatigue strength of approximately 150 MPa.

According to the present invention, it is possible to miniaturize aluminum alloy material crystal grains to the order of several microns and secure a Vickers hardness of an aluminum alloy material of Hv 100 or more. Accordingly, both toughness and fatigue strength of an aluminum alloy material can be improved.

This description includes part or all of the contents as disclosed in the description and/or drawings of Japanese Patent Application No. 2007-032017, which is a priority document of the present application.

BRIEF DESCRIPTION OF THE DRAWINGS

FIG. 3 (*a*) shows an image of the aluminum alloy material tissue obtained in Example 2. FIG. 3 (*b*) shows an image of the aluminum alloy material tissue obtained in Comparative Example 5.

BEST MODE FOR CARRYING OUT THE INVENTION

The present invention is hereafter described in greater detail with reference to the following examples, although the technical scope of the present invention is not limited thereto.

Example 1

[Production Process]

Figure 1:
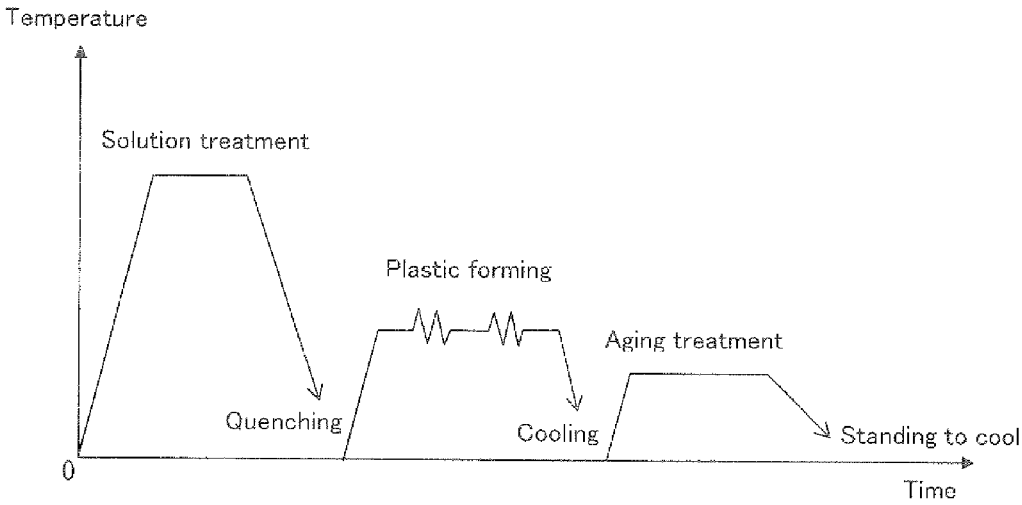
FIG. 1 is an explanatory drawing of the process for producing an aluminum alloy material of the present invention, which shows alloy material temperature history over time.

A heat treatable aluminum alloy material (JIS: A6061) made up of a continuously cast round bar (diameter: 50 mm; length: 150 mm) comprising components listed in table 1 was prepared as a starting material. Next, the aluminum alloy material was subjected to solution treatment by the steps shown in FIG. 1 and table 2. At the beginning, the aluminum alloy material was heated and maintained at 540° C. such that precipitation strengthening elements in the aluminum alloy material were formed into a solid solution. Then, the aluminum alloy material comprising the solid solution was immersed in water at 75° C. for quenching.

TABLE 1

| | Component | | | | | | | | |
|---|---|---|---|---|---|---|---|---|---|
| | Si | Fe | Cu | Mn | Mg | Cr | Zn | Ti | Al |
| % by weight | 0.65 | 0.16 | 0.24 | 0.09 | 1.2 | 0.12 | 0.10 | 0.02 | Remnant |

Next, the aluminum alloy material was heated to a temperature of 150° C., which was much lower than the recrystallization temperature, in order to achieve temperature conditions that do not cause softening of an aluminum alloy material subjected to solution treatment by over-aging. The above heating temperature was maintained for 10 minutes, during which the aluminum alloy material was repeatedly subjected to warm forging forming (multiaxial forging) as shown in (*a*) to (*d*) in FIG. 2 in a manner such that a given amount of equivalent strain (corresponding to the total amount of strain obtained as a result of forging ((*a*) to (*d*))) was imparted to the aluminum alloy material from at least two directions for plastic forming. Specifically, as shown in (*a*) in FIG. 2, a round-bar-shaped aluminum alloy material W1 was placed between upper and lower molds 11A and 11B used for forging and the upper mold 11A was pressurized toward the mold 11B. Thus, the round-bar-shaped aluminum alloy material W1 was forged into a square-bar-shaped aluminum alloy material W2. Then, as shown in (*b*) in FIG. 2, the square-bar-shaped aluminum alloy material W2 was rotated around its axis by 45° and placed between upper and lower molds 12A and 12B, provided that the cross section of the mold space formed inside the molds was smaller than the cross section of the square bar. Further, the upper mold 12A was pressurized toward the lower mold 12B in a manner different in terms of the position of the square bar from that shown in (*a*) in FIG. 2.

Figure 2:
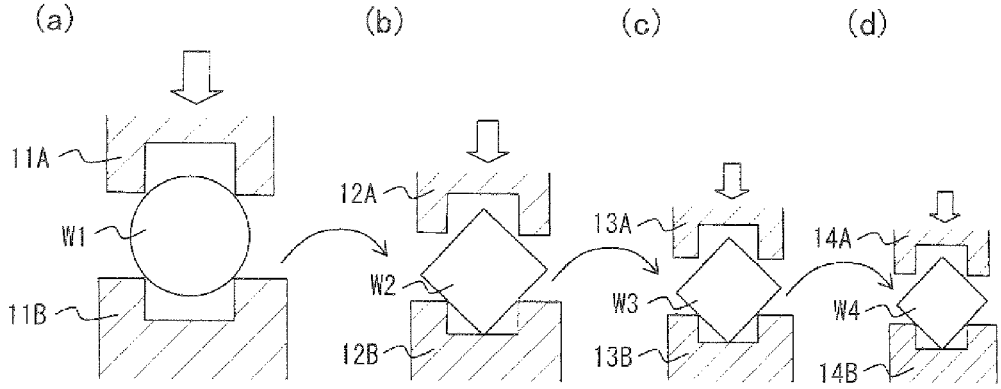
FIG. 2 is an explanatory drawing of a multiaxial forging step (a step of carrying out plastic forming) that is applied to an aluminum alloy material.

Thus, the square-bar-shaped aluminum alloy material W2 was forged into a square-bar-shaped aluminum alloy material W3. Thereafter, forging was carried out in the order of (*c*) and (*d*) as shown in FIG. 2 by steps similar to those described above. After forging, water cooling was carried out under conditions of 30° C./second.

Further, aging treatment (artificial aging treatment) was carried out by heating the aluminum alloy material subjected to forging at a temperature of 180° C. for 5 hours.

TABLE 2

| | Process | | | | |
|---|---|---|---|---|---|
| | 1 | 2 | 3 | 4 | 5 |
| Example 1 | Solution treatment | Quenching | Multiaxial warm forging 1 | Water cooling | Artificial aging treatment |
| Example 2 | Solution treatment | Quenching | Multiaxial warm forging 1 | Air cooling | Artificial aging treatment |
| Example 3 | Solution treatment | Quenching | Multiaxial warm forging 2 | Water cooling | Artificial aging treatment |
| Example 4 | Solution treatment | Quenching | Multiaxial warm forging 2 | Air cooling | Artificial aging treatment |
| Example 5 | Solution treatment | Quenching | Multiaxial warm forging 4 | Air cooling | Artificial aging treatment |
| Comparative Example 1 | Solution treatment | Quenching | Multiaxial warm forging 3 | Water cooling | Artificial aging treatment |
| Comparative Example 2 | Solution treatment | Quenching | Hot forging | Water cooling | Artificial aging treatment |
| Comparative Example 3 | Solution treatment | Quenching | Hot forging | Air cooling | Artificial aging treatment |
| Comparative Example 4 | Hot forging | Standing to cool | Solution treatment | Quenching | Artificial aging treatment |
| Comparative Example 5 | Multiaxial warm forging 2 | Standing to cool | Solution treatment | Quenching | Artificial aging treatment |
| Comparative Example 6 | Solution treatment | Quenching | Artificial aging treatment | Multiaxial warm forging 2 | Water cooling |

Multiaxial warm forging 1: 150° C.; Multiaxial warm forging 2: 250° C. Multiaxial warm forging 3: 300° C.; Multiaxial warm forging 4: 15° C.

TABLE 3

| | Temperature history (° C.) in the process shown in table 2 (water cooling/air cooling/standing to cool (° C./sec)) | | | | |
|---|---|---|---|---|---|
| | 1 | 2 | 3 | 4 | 5 |
| Example 1 | 540 | 75 | 150 | 30 | 180 |
| Example 2 | 540 | 75 | 150 | 5 | 180 |
| Example 3 | 540 | 75 | 250 | 30 | 180 |
| Example 4 | 540 | 75 | 250 | 5 | 180 |
| Example 5 | 540 | 75 | 15 | 5 | 180 |
| Comparative Example 1 | 540 | 75 | 300 | 30 | 180 |
| Comparative Example 2 | 540 | 75 | 450 | 30 | 180 |
| Comparative Example 3 | 540 | 75 | 450 | 5 | 180 |
| Comparative Example 4 | 450 | 0.5 | 540 | 75 | 180 |
| Comparative Example 5 | 250 | 0.5 | 540 | 75 | 180 |
| Comparative Example 6 | 540 | 75 | 190 | 250 | 30 |

<Tensile Test and Fatigue Test>

Then, test pieces were obtained from the aluminum alloy materials subjected to aging treatment by parallel cutting in a manner each piece had a section diameter of 10 mm and a length of 70 mm, followed by surface hardness measurement with a Vickers hardness tester. In addition, a tensile test and a fatigue test were carried out for evaluation of mechanical properties. The results are shown in table 4 below.

<Tissue Observation and Average Grain Size Measurement>

Forged products of the aluminum alloy materials subjected to aging treatment were cut vertically with respect to the axis direction. The excised forged products were mirror-polished. Then, surface tissue observation was carried out by the SEM-EBSP method, followed by average grain size measurement. The results are shown in table 4 below.

TABLE 4

| | Average grain size (μm) | Hardness (Hv) | Toughness (MPa) | Fatigue strength (MPa) |
|---|---|---|---|---|
| Example 1 | 0.7 | 126 | 371 | 150 |
| Example 2 | 1.0 | 125 | 370 | 152 |
| Example 3 | 3 | 118 | 365 | 148 |
| Example 4 | 5 | 112 | 363 | 145 |
| Example 5 | 0.5 | 128 | 375 | 151 |
| Comparative Example 1 | 7 | 72 | 161 | 126 |
| Comparative Example 2 | 52 | 56 | 146 | 111 |
| Comparative Example 3 | 87 | 55 | 142 | 108 |
| Comparative Example 4 | 196 | 122 | 278 | 103 |
| Comparative Example 5 | 286 | 120 | 275 | 102 |
| Comparative Example 6 | Crack generation in material | | | |

Examples 2 to 5

Example 2: An aluminum alloy material was produced as in Example 1. Example 2 differs from Example 1 in that air cooling was carried out after forging at a cooling rate of 5° C./second as shown in tables 2 and 3.

Example 3: An aluminum alloy material was produced as in Example 1. Example 3 differs from Example 1 in that the heating temperature upon forging was 250° C. as shown in tables 2 and 3.

Example 4: An aluminum alloy material was produced as in Example 1. Example 4 differs from Example 1 in that the heating temperature upon forging was 250° C. and air cooling was carried out after forging at a cooling rate of 5° C./second as shown in tables 2 and 3.

Example 5: An aluminum alloy material was produced as in Example 1. Example 5 differs from Example 1 in that heating was not carried out upon forging (at a forging temperature of 15° C.) air cooling was carried out after forging at a cooling rate of 5° C./second as shown in tables 2 and 3.

In addition, a tensile test, a fatigue test, and tissue observation were carried out for the aluminum alloy materials in Examples 2 to 5 under the same conditions as in Example 1. The results are shown in table 4.

Figure 3:
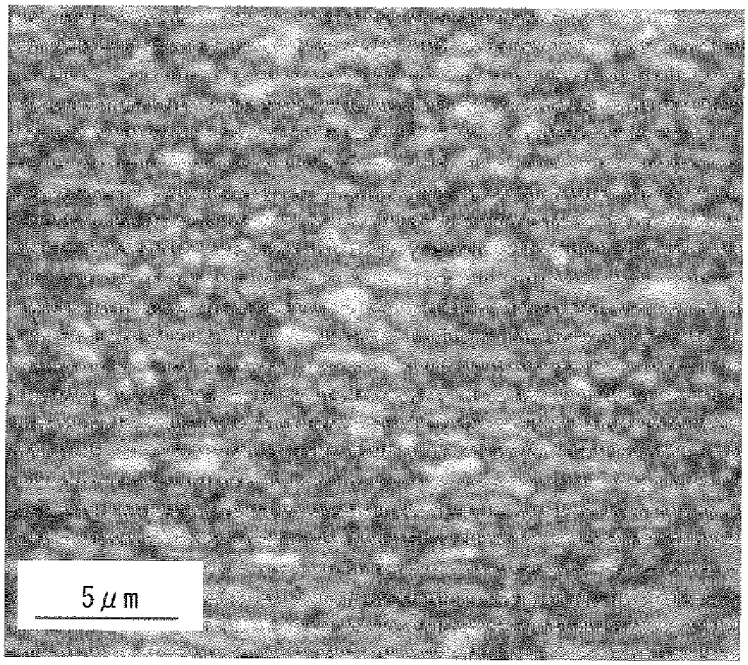
FIGS. 3 (*a*) and (*b*) show aluminum alloy material tissue images.
Figure 3:
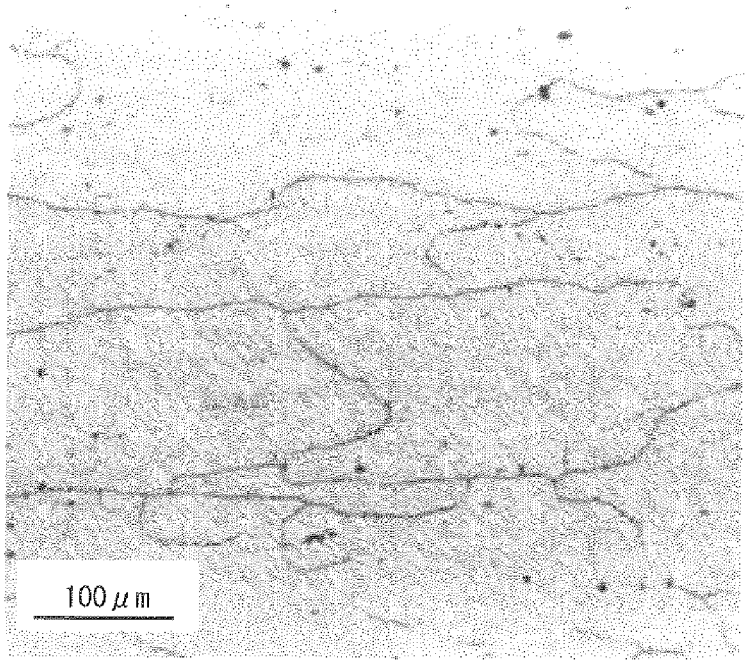

In addition, FIG. 3 (*a*) shows results of surface tissue observation by the SEM-EBSP method.

Comparative Examples 1 to 6

Comparative Example 1: An aluminum alloy material was produced as in Example 1. Comparative Example 1 differs from Example 1 in that the heating temperature upon forging was 300° C. as shown in tables 2 and 3.

Comparative Example 2: An aluminum alloy material was produced as in Example 1. Comparative Example 2 differs from Example 1 in that forging (hot forging) was carried out by heating at a heating temperature upon forging of 450° C., which is above the recrystallization temperature, as shown in tables 2 and 3.

Comparative Example 3: An aluminum alloy material was produced as in Example 1. Comparative Example 3 differs from Example 1 in that forging (hot forging) was carried out by heating at a heating temperature upon forging of 450° C., which is above the recrystallization temperature, and air cooling was carried out after forging at a cooling rate of 5° C./second as shown in tables 2 and 3.

Figure 4:
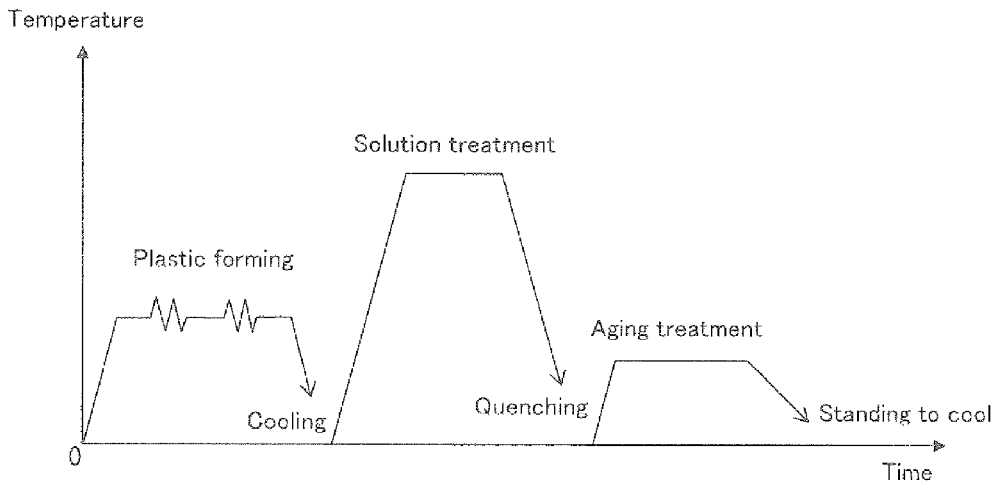
FIG. 4 is an explanatory view of a conventional process for producing an aluminum alloy material, which shows alloy material temperature history over time.

Comparative Example 4: An aluminum alloy material was prepared in a manner similar to that shown in FIG. 4. Specifically, a heat treatable aluminum alloy material similar to that used in Example 1 was prepared. Hot forging (hot plastic forming) was carried out under the conditions described in Comparative Example 3. The forged aluminum alloy material was allowed to stand to cool at 0.5° C./second. Next, the aluminum alloy material forged under the same conditions as in Example 1 was subjected to solution treatment. The aluminum alloy material subjected to solution treatment was further subjected to aging treatment.

Comparative Example 5: An aluminum alloy material was produced as in Comparative Example 4. Comparative Example 5 differs from Comparative. Example 4 in that warm forging was carried out at 250° C. rather than a hot forging treatment.

Then, a tensile test, a fatigue test, and tissue observation were carried out for aluminum alloy materials in Comparative Examples 1 to 5 under the same conditions as in Example 1. The results are shown in table 4. In addition, FIG. 3 (*b*) shows results of surface tissue observation by the SEM-EBSP method in Comparative Example 5.

Comparative Example 6: A heat treatable aluminum alloy material similar to that in Example 1 was prepared and subjected to solution treatment under the same conditions as in Example 1. The aluminum alloy material subjected to solution treatment was further subjected to aging treatment in the same manner as in Example 1. After the aging treatment, forging was carried out as in the case of Example 2 under heating conditions of 250° C. The results are shown in table 4.

(Results)

Each of the aluminum alloy materials in Examples 1 to 5 had an average grain size of 5.0 μm or less and a Vickers hardness of Hv 100 or more. In addition, each of them had a toughness of 350 MPa or more and a fatigue strength of approximately 150 MPa.

Each of the aluminum alloy materials in Comparative Examples 1 to 3 had an average grain size of more than 5.0 μm and a Vickers hardness of less than Hv 100. In addition, each of the aluminum alloy materials in Comparative Example 1 to 3 had a toughness of 200 MPa or less and a fatigue strength of approximately 110 to 120 MPa. The obtained toughnesses and fatigue strengths were lower than those obtained in Examples 1 to 5.

As shown in FIG. 3 (*b*), each of the aluminum alloy materials in Comparative Examples 4 and 5 had an average grain size of 200 μm or more and a Vickers hardness of Hv 100 or more. In addition, each of the aluminum alloy materials in Comparative Examples 4 and 5 had a toughness of 300 MPa or less and a fatigue strength of approximately 100 MPa. The obtained toughnesses and fatigue strengths were lower than those obtained in Examples 1 to 5.

(Discussion 1)

The toughness and the fatigue strength of the aluminum alloy material obtained in Comparative Example 1 were lower than those obtained in Examples 1 to 5. This was probably because the Vickers hardness thereof was low. Regarding the reason for such low Vickers hardness, it is considered that the heating temperature upon forging in Comparative Example 1 was higher than heating temperatures in Examples 1 to 5, resulting in over-aging of the aluminum alloy material upon forging. In order to carry out aging treatment following forging, it is necessary to carry out heating upon forging under heating conditions that do not cause softening of the aluminum alloy material subjected to solution treatment by over-aging. More preferably, forging forming (plastic forming) is carried out at a temperature of 0° C. to 250° C. at which an aluminum alloy material is less likely to become softened by over-aging during a given time period of forging forming (a time period for forming that results in an amount of equivalent strain of 2 or more). In addition, it is thought that it would become possible to obtain an aluminum alloy material having excellent toughness and fatigue strength represented by a toughness of more than 350 MPa and a fatigue strength of approximately 150 MPa as in the cases of the aluminum alloy materials in Examples 1 to 4 by carrying out plastic forming to achieve an average crystal grain size of 5.0 μm or less and carrying out aging treatment in an aging step to achieve a Vickers hardness of Hv 123 or more.

(Discussion 2)

When hot forging was carried out as in Comparative Examples 2 and 3, it was more difficult to cause strain generation, which is necessary for crystal grain miniaturization, compared with Examples 1 to 5. In addition, crystal grain growth took place during cooling because the cooling rate after hot forging in Comparative Example 3 was lower than that in Comparative Example 2. Such crystal grain growth was thought to cause an increase in average grain size (coarsening of crystal grains) during the cooling. Therefore, it is considered that the toughness and the fatigue strength decreased compared with those obtained in Examples 1 to 5, even though aging treatment was carried out after hot forging.

(Discussion 3)

When solution treatment was carried out following forging as in Comparative Examples 4 and 5, it caused recrystallization/grain growth in an aluminum alloy material. It is considered that such recrystallization/grain growth caused an increase in average grain size in Comparative Examples 4 and 5, compared with Examples 1 to 5. Therefore, it is considered that the toughness and the fatigue strength decreased compared with Examples 1 to 5, although the aluminum alloy materials having large average grain sizes in Comparative Examples 4 and 5 were subjected to aging treatment after a solution treatment.

(Discussion 4)

When aging treatment was carried out prior to forging as in Comparative Example 6, hardness increased due to the presence of precipitates. Therefore, it is thought that such increase resulted in crack generation upon forging.

The invention claimed is:

1. A process for producing an aluminum alloy material comprising at least the steps of subjecting a heat treatable aluminum alloy material to solution treatment and applying aging treatment to the aluminum alloy material subjected to solution treatment, which further comprises the following step between the solution treatment step and the aging treatment step:

the step of subjecting the aluminum alloy material to forging forming in a manner such that an equivalent strain amount of 2 or more is imparted to the aluminum alloy material from at least two directions while the aluminum alloy material subjected to solution treatment is maintained within a temperature range of 150° C. to 250° C. and under temperature conditions that do not cause softening of the aluminum alloy material by over-aging.

2. The process for producing an aluminum alloy material according to claim 1, wherein the forging forming is carried out to achieve the average grain size of the crystal grains the aluminum alloy material of 5.0μm or less.

3. The process for producing an aluminum alloy material according to claim 2, wherein the aging treatment is carried out to achieve a Vickers hardness of the aluminum alloy material of Hv 112 or more.

4. The process for producing an aluminum alloy material according to claim 1, wherein after the aluminum alloy material is heated at the temperature conditions during the step of carrying out the forging forming, the aging treatment is carried out while the heated state of the aluminum alloy material in the step of carrying out the forging forming is maintained.

* * * * *